US007886870B2

(12) United States Patent
Hanai et al.

(10) Patent No.: US 7,886,870 B2
(45) Date of Patent: Feb. 15, 2011

(54) EXHAUST APPARATUS FOR SMALL BOAT

(75) Inventors: Toshinori Hanai, Saitama (JP); Masatsugu Matsumoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 199 days.

(21) Appl. No.: 12/055,036

(22) Filed: Mar. 25, 2008

(65) Prior Publication Data

US 2008/0236942 A1 Oct. 2, 2008

(51) Int. Cl.
*F01N 13/12* (2010.01)

(52) U.S. Cl. ..... 181/235; 181/250; 181/212; 440/89 R; 440/89 J

(58) Field of Classification Search ..... 181/250, 181/235, 212, 227, 228, 259, 272, 269; 440/89 R, 440/89 J See application file for complete search history.

(56) References Cited

U.S. PATENT DOCUMENTS 5,550,337 A * 8/1996 Tazaki et al. ..... 181/235
5,726,397 A * 3/1998 Mukai et al. ..... 181/232
6,102,154 A * 8/2000 Liu et al. ..... 181/265
6,764,361 B1 * 7/2004 Matsuda ..... 440/89 B
7,156,710 B2 * 1/2007 Yokoya et al. ..... 440/89 J
7,506,723 B2 * 3/2009 Hoerr et al. ..... 181/250
2005/0230182 A1 * 10/2005 Nezan et al. ..... 181/250
2005/0279572 A1 * 12/2005 Birgersson ..... 181/272

FOREIGN PATENT DOCUMENTS

JP 2004-270650 A 9/2004
JP 2005-59794 A 3/2005

* cited by examiner

*Primary Examiner*—Elvin G Enad
*Assistant Examiner*—Forrest M Phillips
(74) *Attorney, Agent, or Firm*—Birch, Stewart, Kolasch & Birch, LLP

(57) ABSTRACT

An exhaust apparatus for a small boat for reducing exhaust noise. A water muffler is provided at a midsection of the exhaust pipes extending from an engine which is provided in a boat body. An interior of the water muffler is partitioned into an expansion chamber and a resonator chamber with a front exhaust pipe connected to the engine and a rear exhaust pipe opening out of the boat being interlinked with the expansion chamber. The resonator chamber is directly connected to the midsection of the rear exhaust pipe via a connecting pipe. The water muffler is arranged in a longitudinal direction that is oriented in the fore-and-aft direction so as to extend along the side of a pump chamber in which a jet pump driven by the engine is arranged. A second resonator chamber is arranged along the water muffler on the outer side of the water muffler.

20 Claims, 5 Drawing Sheets

EXHAUST APPARATUS FOR SMALL BOAT

CROSS-REFERENCE TO RELATED APPLICATIONS

The present application claims priority under 35 USC 119 to Japanese Patent Application No. 2007-085444 filed on Mar. 28, 2007 the entire contents of which are hereby incorporated by reference.

BACKGROUND OF THE INVENTION

1. Field of the Invention

The present invention relates to an exhaust apparatus for a small boat.

2. Description of Background Art

In the related art, as an exhaust apparatus is known for a small boat wherein an apparatus includes a water muffler provided at a midsection of an exhaust pipe extending from an engine provided in a boat body. The interior of the water muffler is partitioned into an expansion chamber and a resonator chamber with a front exhaust pipe connected to the engine and a rear exhaust pipe opening out of the boat being interlinked with the expansion chamber. See, for example, JP-A-2004-270650.

According to the exhaust apparatus in this configuration, since the interior of the water muffler is partitioned into the expansion chamber and the resonator chamber (that is, the expansion chamber and the resonator chamber are integrated in the water muffler), downsizing of the exhaust apparatus is achieved and, simultaneously, exhaust noise in a low-frequency band, which is one of the largest problems in the small boat is reduced.

In the related art, an exhaust apparatus is known for a small boat in which a resonator chamber is connected to an expansion chamber in a water muffler via a connecting pipe. See, for example, JP-A-2005-59794

In the exhaust apparatus for a small boat in the related art as described above, downsizing of the exhaust apparatus is achieved. However, the exhaust noise cannot be reduced satisfactorily.

SUMMARY AND OBJECTS OF THE INVENTION

It is an object of the present invention to solve the above-described problem and provide an exhaust apparatus for a small boat in which exhaust noise is satisfactorily reduced.

In order to achieve the above-described object, an exhaust apparatus for a small boat according to an embodiment of the present invention including a water muffler at a midsection of an exhaust pipe extending from an engine provided in a boat body, in which the interior of the water muffler is partitioned into an expansion chamber and a resonator chamber. A front exhaust pipe is connected to the engine and a rear exhaust pipe opening out of the boat are interlinked with the expansion chamber wherein the resonator chamber is directly connected to a midsection of the rear exhaust pipe via a connecting pipe.

Preferably, a second resonator chamber is provided at a position adjacent to the water muffler, and the second resonator chamber is connected to the expansion chamber via a second connecting pipe.

More preferably, the water muffler is formed into a cylindrical shape and is arranged along the side of a pump chamber in which a jet pump driven by the engine is arranged with the longitudinal direction thereof oriented in the fore-and-aft direction, and the second resonator chamber is arranged so as to extend along the water muffler on the outer side of the water muffler.

According to the exhaust apparatus for a small boat in the present invention, the water muffler is provided in the midsection of the exhaust pipe extending from the engine provided in the boat body, the interior of the water muffler is partitioned into the expansion chamber and the resonator chamber, and the front exhaust pipe connected to the engine and the rear exhaust pipe opening out of the boat are interlinked with the expansion chamber. Therefore, downsizing of the exhaust apparatus is achieved.

Since the resonator chamber is directly connected to the midsection of the rear exhaust pipe via the connecting pipe, the function of the resonator chamber as a resonator with respect to the rear exhaust pipe is directly and satisfactorily achieved.

Therefore, with the exhaust apparatus for this small boat, the exhaust noise is satisfactorily reduced.

Since the second resonator chamber is provided at the position adjacent to the water muffler, and the second resonator chamber is connected to the expansion chamber via the second connecting pipe, the exhaust noise, especially strident low-frequency noise is satisfactorily reduced.

With the configuration in which the interior of the water muffler is partitioned into the expansion chamber and the resonator chamber (that is, the expansion chamber and the resonator chamber are integrated in the water muffler), and the resonator chamber is directly connected to the intermediate portion of the rear exhaust pipe via the connecting pipe when providing such a second resonator chamber as in the present invention, there arises a problem with respect to how the second resonator chamber is provided relative to the water muffler.

In order to cope with this problem, the water muffler is formed into a cylindrical shape, and is arranged in such a manner that the longitudinal direction thereof is oriented in the fore-and-aft direction so as to extend along the side of the pump chamber in which the jet pump driven by the engine is arranged, and the second resonator chamber is arranged along the water muffler on the outer side of the water muffler, so that the above-described problem is solved, and a dead space which is apt to be generated on the outer side of the water muffler in the boat body is effectively used.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
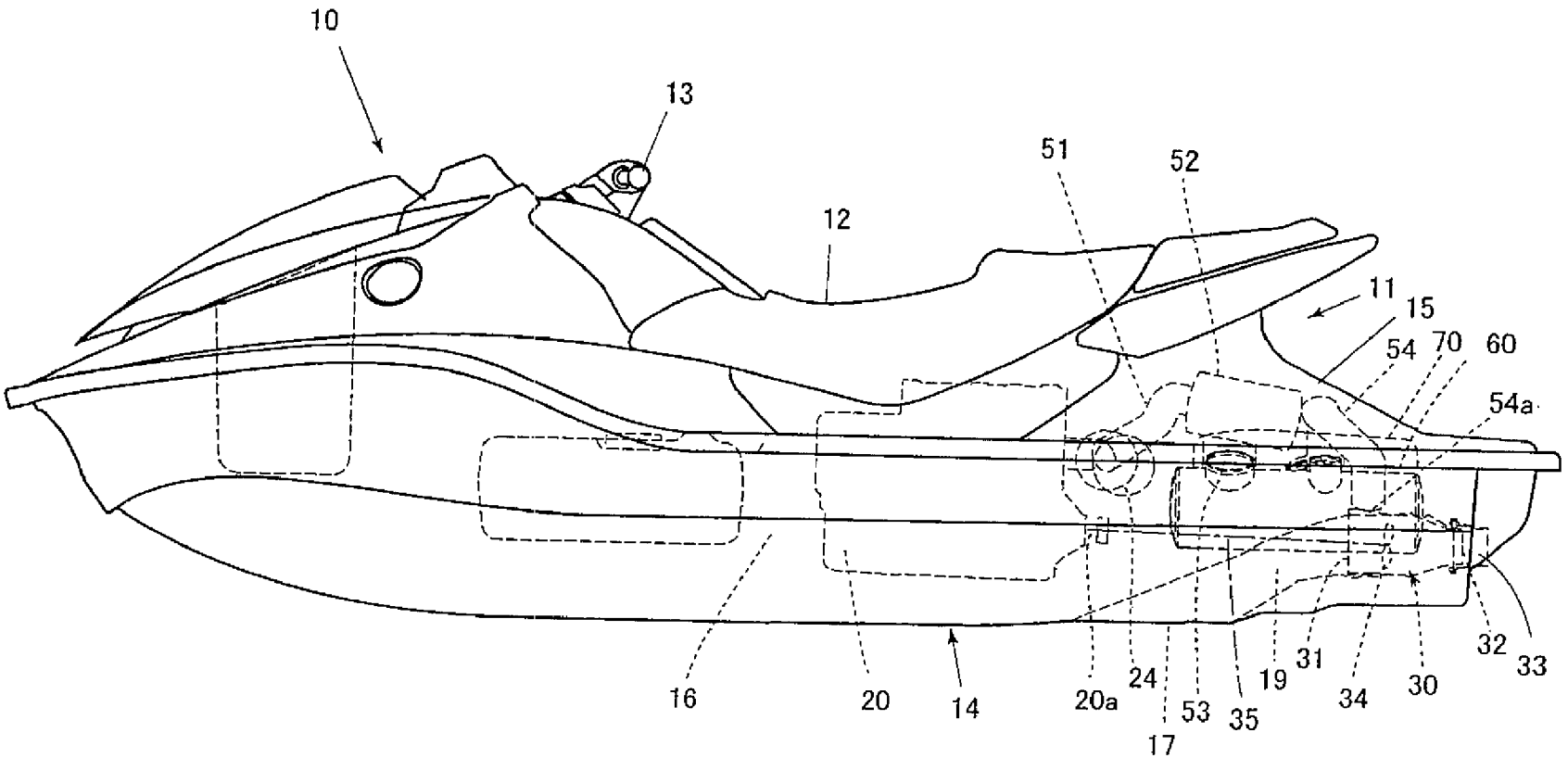
FIG. 1 is a schematic side view showing an example of a small boat in which an exhaust apparatus for a small boat according to an embodiment of the present invention is used.

Referring now to the drawings, an embodiment of an exhaust apparatus for a small boat according to the present invention will be described.

Figure 2:
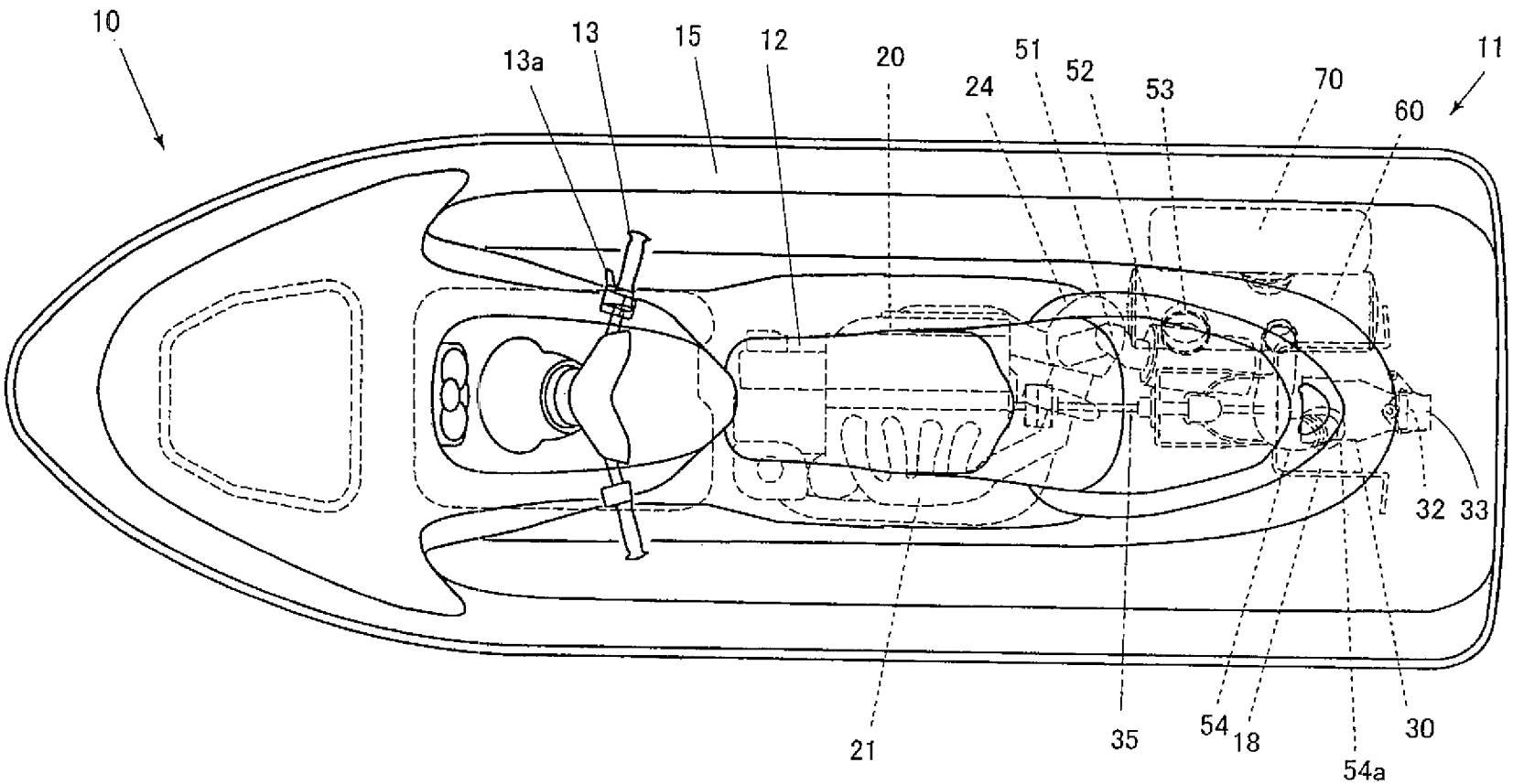
FIG. 2 is a schematic plan view of the same.

FIG. 1 is a schematic side view showing an example of a small boat in which an exhaust apparatus for a small boat according to an embodiment of the present invention is used, and FIG. 2 is a schematic plan view.

As shown in FIG. 1 and FIG. 2, a small boat 10 is a saddle type small boat, in which a passenger is seated on a seat 12 on a boat body 11 and grips a steering handle 13 with a throttle lever 13*a* to travel.

The boat body 11 has a floating structure in which a hull 14 and deck 15 are joined to form a space 16 in the interior thereof. In the space 16, an engine 20 is mounted on the hull 14, and a jet pump (jet propulsion pump) 30 as a propulsion means driven by the engine 20 is provided on the rear portion of the hull 14.

Figure 3A:
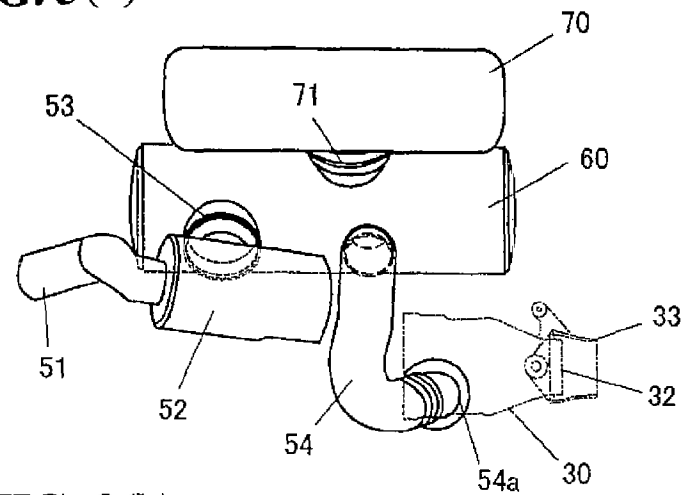
FIGS. 3(*a*) to 3(*c*) are drawings showing an exhaust system, in which FIG. 3(*a*) is a plan view, FIG. 3(*b*) is a side view (a front view of the drawing in FIG. 3(*a*)), and FIG. 3(*c*) is a back view partly omitted.
Figure 3B:
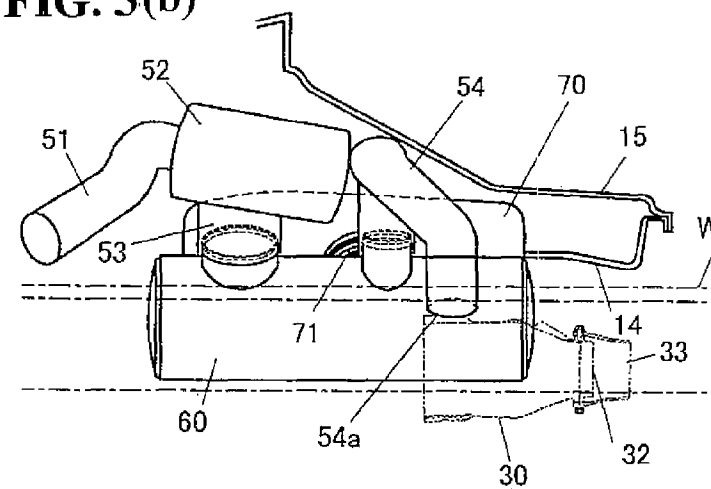
Figure 3C:
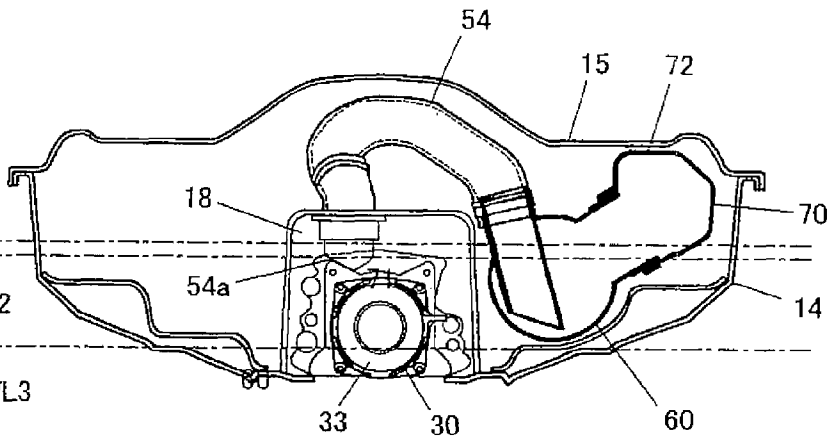

A flow path 19 extending from a water intake port 17 and opening on a boat's bottom to a pump chamber 18 (see FIG. 2, FIG. 3(*c*)) is provided on the rear portion of the hull 14. The jet pump 30 is in communication with the flow path 19 and is provided in the pump chamber 18.

The jet pump 30 includes an opening 31 which is in communication with the flow path 19, a jet flow port 32 and a nozzle 33 for injecting water toward the rear of the boat body and an impeller 34 arranged in a flow path extending from the opening 31 to the jet flow port 32, and a shaft 35 of the impeller 34 is connected to an output shaft 20*a* of the engine 20. Therefore, when the impeller 34 is driven by the engine 20 into rotation, water taken through the water intake port 17 is injected from the jet flow port 32 through the nozzle 33, whereby the boat body 11 is propelled. The number of revolution of the engine 20, that is, a propulsion force generated by the jet pump 30 is operated by rotating the throttle lever 13*a*. The nozzle 33 is interlocked with the steering handle 13 via a wire, not shown, and is rotated by the operation of the steering handle 13, whereby the course of the boat body is changed.

The engine 20 is an in-line four-cylinder dry-sump type four-cycle engine of a DOHC type, and the crankshaft (output shaft) 20*a* thereof is arranged so as to extend along the fore-and-aft direction of the boat body 11.

A turbo charger 24 is arranged behind the engine 20, and an exhaust port of an engine exhaust manifold 21 is connected to a turbine unit of the turbo charger 24.

Exhaust air which has rotated a turbine at the turbine unit of the turbo charger 24 is discharged through a first exhaust pipe 51 with a water jacket, a reverse flow preventing chamber 52 for preventing reverse flow (entrance of water to the turbo charger 24 or the like) in case of overturning, and a second exhaust pipe 53 (front exhaust pipe) to a water muffler 60 and then is discharged from the water muffler 60 through an air and water discharge pipe (rear exhaust pipe) 54 opening out of the boat (54*a*) to the pump chamber 18 in which the jet pump 30 is arranged.

Therefore, exhaust air from the engine 20 is discharged through exhaust pipes (the first exhaust pipe 51, the reverse flow preventing chamber 52 and the second exhaust pipe 53 in this embodiment) each having the water jacket into the water muffler 60 together with water passed through the water jacket.

FIGS. 3(*a*) to 3(*c*) are drawings showing an exhaust system, in which FIG. 3(*a*) is a plan view, FIG. 3(*b*) is a side view (a front view of the drawing FIG. 3(*a*)) and FIG. 3(*c*) is a back view partly omitted.

Figure 4A:
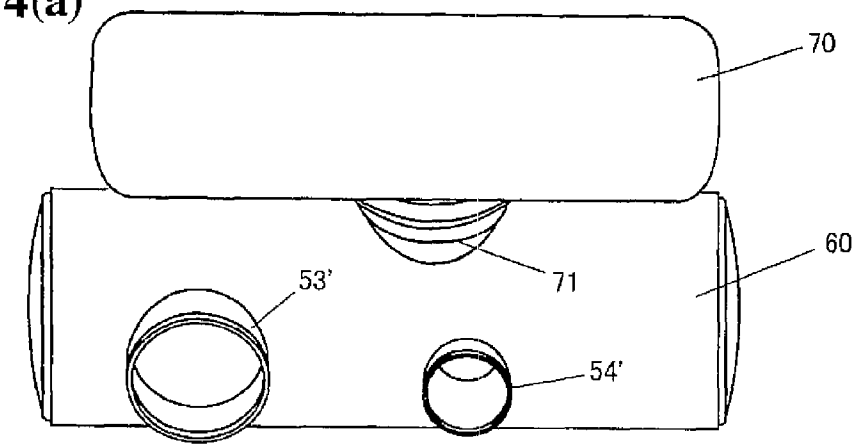
FIGS. 4(*a*) to 4(*c*) are drawings showing a water muffler 60 and a second resonator chamber 70, in which FIG. 3(*a*) is a plan view, FIG. 3(*b*) is a side view, FIG. 3(*c*) is a cross-sectional view taken along the line c-c in the drawing illustrated in FIG. 3(*b*)
Figure 4B:
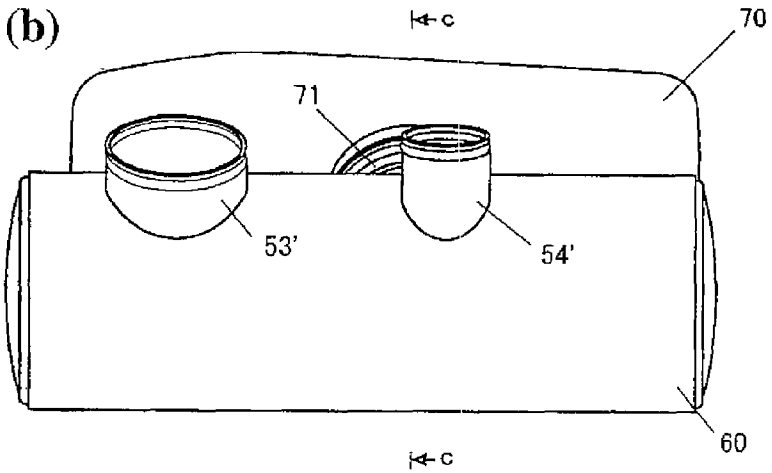
Figure 4C:
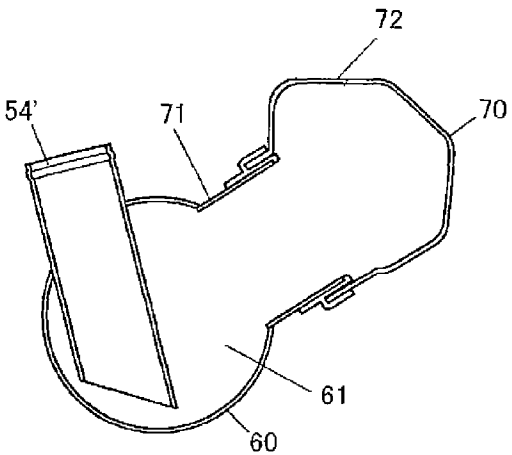

FIGS. 4(*a*) to 4(*c*) are drawings showing the water muffler 60 and a second resonator chamber 70, in which FIG. 4(*a*) is a plan view, FIG. 4(*b*) is a side view and FIG. 4(*c*) is a cross-sectional view taken along the line c-c in the drawing FIG. 4(*b*).

Figures 5A, 5B:
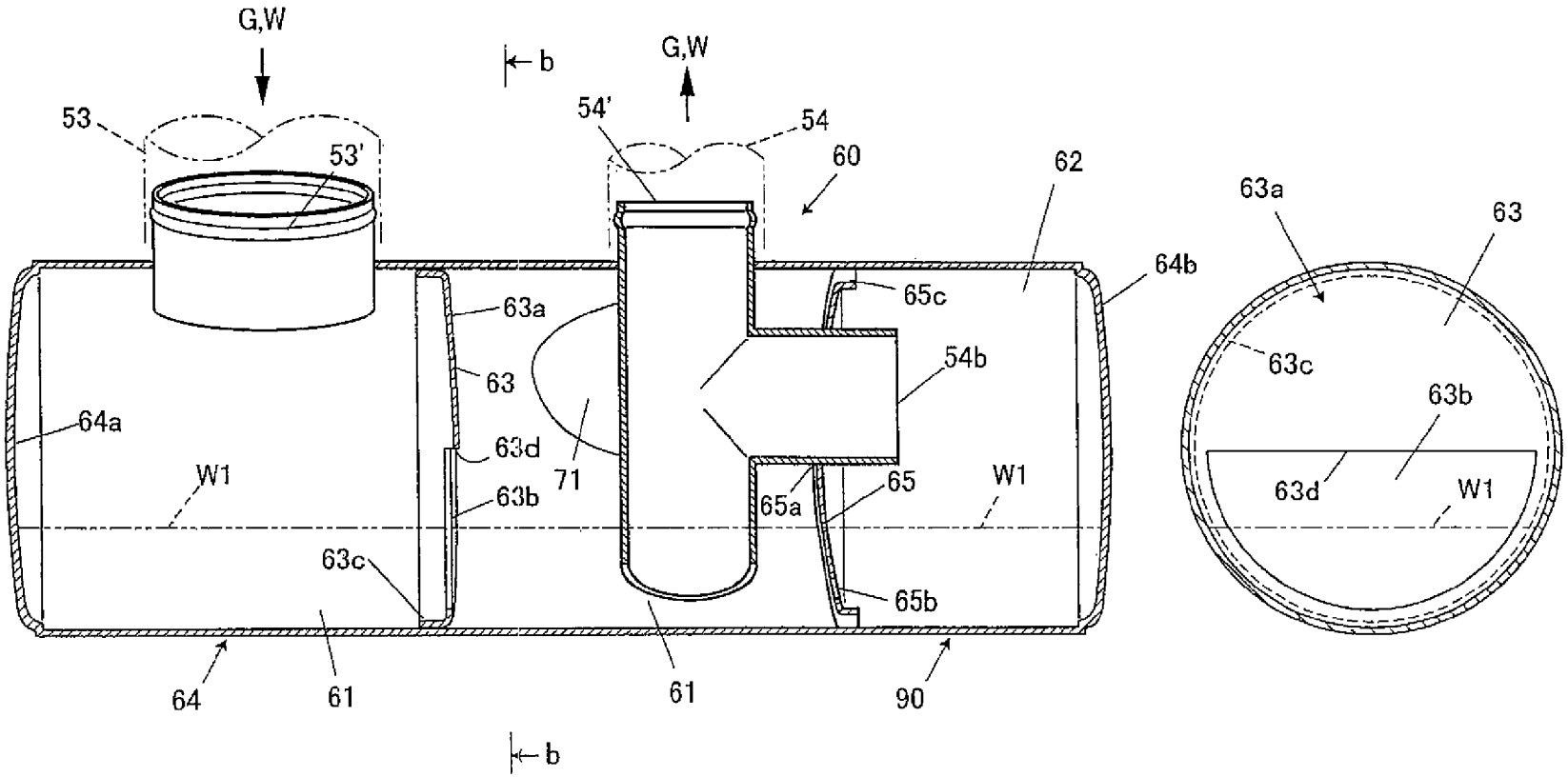
FIGS. 5(*a*) and 5(*b*) are drawings showing the water muffler 60, in which FIG. 5(*a*) is a partially cut-away side view, and FIG. 5(*b*) is a cross-sectional view taken along the line b-b in the drawing illustrated in FIG. 5(*a*) partly omitted.

FIGS. 5(*a*) and 5(*b*) are drawings showing the water muffler 60, in which FIG. 5(*a*) is a partially cut-away side view and FIG. 5(*b*) is a cross-sectional view taken along the line b-b in the drawing FIG. 5(*a*) partly omitted.

As shown in FIGS. 5(*a*) and 5(*b*), the interior of the water muffler 60 is partitioned into a single expansion chamber 61 and a resonator chamber 62. The front exhaust pipe 53 is connected to the engine 20. The rear exhaust pipe 54 opening out of the boat (see connecting pipe 54*a* in FIG. 3(*c*)) is interlinked with the expansion chamber 61.

The resonator chamber 62 is directly connected to a midsection of the rear exhaust pipe 54 via a connecting pipe 54*b*.

As described above, exhaust gas G and cooling water W are introduced from the front exhaust pipe 53 into the water muffler 60, and are discharged from the water muffler 60 through the rear exhaust pipe 54 out of the boat.

The water muffler 60 is provided with a water restraining panel 63 in the upper part of the expansion chamber 61 between the front exhaust pipe 53 and the rear exhaust pipe 54 opening into the expansion chamber 61.

The resonator chamber 62 is characterized in that the attenuation is large in the low-frequency band (200-300 Hz).

The water muffler 60 has a configuration in which the front and rear of a cylindrical member 64 are closed with discs 64*a*, 64*b*, and includes the water restraining panel 63 and a partitioning panel 65 for partitioning the resonator chamber 62 in the interior thereof.

A connecting pipe 53' is connected to an upper portion of the cylindrical member 64 at the front of the water restraining panel 63 by welding or the like, and a connecting pipe 54' is connected to a portion between the water restraining panel 63 and the partitioning panel 65 by welding or the like.

The front exhaust pipe 53 is connected to the connecting pipe 53', and the connecting pipe 53' by itself constitutes part of the front exhaust pipe 53.

The rear exhaust pipe 54 is connected to the connecting pipe 54', and the connecting pipe 54' by itself constitutes part of the rear exhaust pipe 54. The connecting pipe 54*b* for connecting the midsection of the connecting pipe 54' directly to the resonator chamber 62 is integrally provided on the connecting pipe 54'.

The water restraining panel 63 is formed with an opening 63*b* by punching a substantially lower half portion of a disc 63*a* into a semi-circular shape as shown in FIG. 5(*b*), so that the water restraining panel 63 is formed by an upper portion of the disc 63*a*. The disc 63*a* is bent by 90° along the circumference thereof, and a bent portion 63*c* is joined to an inner surface of the cylindrical member 64 by welding or the like and hence is fixed to the cylindrical member 64.

The partitioning panel 65 is bent by 90° along the circumference thereof, and a bent portion 65*c* is joined to the inner surface of the cylindrical member 64 by welding or the like and hence is fixed to the cylindrical member 64. The partitioning panel 65 is provided with a hole 65*a* through which the connecting pipe 54*b* is passed, and a water flowing port 65*b* for returning water in the resonator chamber 62 into the expansion chamber 61.

In FIGS. 5(*a*) and 5(*b*), W1 indicates a water level of water discharged into the water muffler 60 together with exhaust air from the front exhaust pipe 53. A lower end 63*d* (upper end of the opening 63*b*) of the water restraining panel 63 is positioned above the water level W1, and the connecting pipe 54*b* is also positioned above the water level W1. The water flowing port 65*b* is positioned below the water level W1.

As shown in FIG. 4, the water muffler 60 is provided with the second resonator chamber 70 at a position adjacent thereto. The second resonator chamber 70 is connected to the expansion chamber 61 of the water muffler 60 via a second connecting pipe 71.

As shown in FIG. 4(*c*), the second connecting pipe 71 and the second resonator chamber 70 are directed obliquely upward from the expansion chamber 61 so as to prevent water from accumulating in the second connecting pipe 71 and the second resonator chamber 70.

Therefore, granted that water enters the second connecting pipe 71 or the second resonator chamber 70, the water is returned to the expansion chamber 61, and is discharged out of the boat via the rear exhaust pipe 54 together with the exhaust gas G.

The second resonator chamber 70 is configured in such a manner that an upper surface (upper panel) 72 extends in parallel to an inner surface of the deck 15 as shown in FIG. 3(*c*) in order to secure an effective capacity.

As shown in FIG. 2 and FIGS. 3(*a*) to 3(*c*), and as described above, the water muffler 60 is configured to be a cylindrical shape, and is arranged along the side of the pump chamber 18 with the longitudinal direction thereof oriented in the fore-and-aft direction and the second resonator chamber 70 is also configured to be a cylindrical shape and is arranged so as to extend along the water muffler 60 on the outer side of the water muffler 60 with the longitudinal direction thereof oriented in the fore-and-aft direction.

As shown in FIG. 2 and FIG. 3(*c*), the air and water discharge port 54*a* of the rear exhaust pipe 54 opens into the pump chamber 18.

In FIGS. 3(*b*) and 3(*c*), reference signs WL1, WL2 and WL3 designate draft lines (more specifically, the position of the water surface in the pump chamber 18).

The reference sign WL1 designates a draft line when the boat is moored, the reference sign WL2 is a draft line when the boat body is started to be lifted by the travel of the small boat 10, and reaches a speed at which the air and water discharge port 54*a* of the rear exhaust pipe 54 appears from the water surface, and the reference sign WL3 is a draft line when the small boat 10 is brought into a high-speed traveling (sliding) state.

As is clear from the same drawings, the air and water discharge port 54*a* of the rear exhaust pipe 54 is submerged under water when the small boat 10 is moored or travels at a low speed (in general, a speed obtained when the number of revolution of the engine is 0 to 2000 rpm) and comes out from water (positioned above the draft lines WL2 and WL3) when the speed of the small boat 10 is started to increase (in general, a speed obtained when the number of revolution of the engine exceeds 2000 rpm).

According to the exhaust apparatus for a small boat as described above, the following effects and advantages are obtained.

Since the water muffler 60 is provided at the midsection of the exhaust pipe extending from the engine 20 which is provided in the boat body, the interior of the water muffler 60 is partitioned into the expansion chamber 61 and the resonator chamber 62, and the front exhaust pipe 53 connected to the engine 20 and the rear exhaust pipe 54 opening out of the boat are interlinked with the expansion chamber 61. Thus, downsizing of the exhaust apparatus is achieved.

Since the resonator chamber 62 is directly connected to the midsection of the rear exhaust pipe 54 via the connecting pipe 54*b*, the function of the resonator chamber 62 as a resonator with respect to the rear exhaust pipe 54 is directly and satisfactorily achieved.

Therefore, with the exhaust apparatus for a small boat, exhaust noise is satisfactorily reduced.

(b) Since the second resonator chamber 70 is provided at the position adjacent to the water muffler 60 and the second resonator chamber 70 is connected to the expansion chamber 61 via the second connecting pipe 71, the exhaust noise, especially strident low-frequency noise is satisfactorily reduced.

With the configuration in which the interior of the water muffler 60 is partitioned into the expansion chamber 61 and the resonator chamber 62 (that is, the expansion chamber 61 and the resonator chamber 62 are integrated in the water muffler 60), and the resonator chamber 62 is directly connected to the intermediate portion of the rear exhaust pipe 54 via the connecting pipe 54*b* when providing the second resonator chamber 70 as described above as in this embodiment, there arises a problem with respect to how the second resonator chamber is provided relative to the water muffler.

In order to cope with this problem, according to this embodiment, the water muffler 60 is formed into a cylindrical shape, and is arranged in such a manner that the longitudinal direction thereof is oriented in the fore-and-aft direction so as to extend along the side of the pump chamber 18 in which the jet pump driven by the engine 20 is arranged, and the second resonator chamber 70 is arranged along the water muffler 60 on the outer side of the water muffler 60, so that the above-described problem is solved. Thus, a dead space which is apt to be generated on the outer side of the water muffler 60 in the boat body is effectively used.

(c) Since the air and water discharge port 54*a* is arranged at a position where it is submerged under water when the small boat 10 is moored or travels at a low speed, and comes out from the water when the speed of the small boat 10 is started to increase, the following effects and advantages are obtained.

When the small boat 10 is moored or travels at a low speed, the air and water discharge port 54*a* is submerged under water, so that a silencing effect is obtained.

On the other hand, when the speed of the small boat 10 is increased, the air and water discharge port 54*a* comes out from water. Thus, the exhaust resistance is reduced as well, so that a high power of the engine is obtained. Thus, a desirable high-speed traveling is achieved.

Although the embodiment of the present invention has been described thus far, the invention is not limited to the above-described embodiments, and may be modified as needed within the scope of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust apparatus for a small boat comprising:

a water muffler at a midsection of an exhaust pipe extending from an engine provided in a boat body;

an interior of the water muffler being partitioned into an expansion chamber and a resonator chamber;

a front exhaust pipe being connected to the engine; and a rear exhaust pipe opening out of the boat, said rear exhaust pipe being interlinked with the expansion chamber;

wherein the resonator chamber is directly connected to a midsection of the rear exhaust pipe via a connecting pipe having a longitudinal axis which extends orthogonally with respect to the rear exhaust pipe and parallel to a longitudinal axis of the resonator chamber.

2. The exhaust apparatus for a small boat according to claim 1, wherein the resonator chamber is located in a rear most portion of the water muffler, and wherein a second resonator chamber is cylindrical in shape and is provided at a position adjacent to the water muffler, and the second resonator chamber is connected to the expansion chamber via a second connecting pipe.

3. The exhaust apparatus for a small boat according to claim 2, wherein the water muffler is formed into a cylindrical shape and is arranged along the side of a pump chamber in which a jet pump driven by the engine is arranged with the longitudinal direction thereof oriented in a fore-and-aft direction, and the second resonator chamber is arranged so as to extend along the water muffler on the outer side of the water muffler.

4. The exhaust apparatus for a small boat according to claim 1, and further including a water restraining panel for partitioning the expansion chamber of the water muffler into two expansion chambers.

5. The exhaust apparatus for a small boat according to claim 4, wherein said water restraining panel includes a closed upper portion and an opening formed in a lower portion.

6. The exhaust apparatus for a small boat according to claim 1, wherein the front exhaust pipe is operatively connected to the expansion chamber at a point adjacent to a closed upper portion of a water restraining panel that partitions the expansion chamber of the water muffler into two expansion chambers.

7. The exhaust apparatus for a small boat according to claim 1, wherein the rear exhaust pipe is operatively connected to the expansion chamber at a point adjacent to an opening formed in a lower portion of a water restraining panel that partitions the expansion chamber of the water muffler into two expansion chambers.

8. The exhaust apparatus for a small boat according to claim 7, wherein an opening of the rear exhaust pipe is disposed below a waterline within said water muffler when the small boat is moored or travels at a low speed and is disposed above the waterline within said water muffler when the small boat reaches a predetermined speed.

9. The exhaust apparatus for a small boat according to claim 1, wherein a partitioning panel partitions the water muffler into the expansion chamber and the resonator chamber, the connecting pipe is operatively connected to the midsection of the rear exhaust pipe and projects through said partitioning panel to extend into the resonator chamber, wherein a side of the partitioning panel facing the expansion chamber is convex-shaped.

10. The exhaust apparatus for a small boat according to claim 9, wherein the partitioning panel includes an aperture in a lower portion thereof for permitting water to flow from the resonator chamber to the expansion chamber.

11. An exhaust apparatus comprising:

a water muffler;

an interior of the water muffler being partitioned into an expansion chamber and a resonator chamber;

a front exhaust pipe being adapted to be connected to an engine; and a rear exhaust pipe opening out of the boat, said rear exhaust pipe being interlinked with the expansion chamber;

wherein the resonator chamber is directly connected to a midsection of the rear exhaust pipe via a connecting pipe having a longitudinal axis which extends parallel to a longitudinal axis of the resonator chamber, wherein a second resonator chamber is provided at a position adjacent to the water muffler, the second resonator chamber extending lengthwise in a direction that is substantially parallel to a lengthwise direction of the water muffler.

12. The exhaust apparatus according to claim 11, wherein the resonator chamber is located in a rear most portion of the water muffler, and wherein a second resonator chamber is cylindrical in shape and is connected to the expansion chamber via a second connecting pipe which extends orthogonally to the lengthwise directions of the water muffler and the second expansion chamber.

13. The exhaust apparatus according to claim 12, wherein the water muffler is formed into a cylindrical shape and is arranged along the side of a pump chamber in which a jet pump driven by the engine is arranged with the longitudinal direction thereof oriented in a fore-and-aft direction, and the second resonator chamber is arranged so as to extend along the water muffler on the outer side of the water muffler.

14. The exhaust apparatus according to claim 11, and further including a water restraining panel for partitioning the expansion chamber of the water muffler into two expansion chambers.

15. The exhaust apparatus according to claim 14, wherein said water restraining panel includes a closed upper portion and an opening formed in a lower portion.

16. The exhaust apparatus according to claim 11, wherein the front exhaust pipe is operatively connected to the expansion chamber at a point adjacent to a closed upper portion of a water restraining panel that partitions the expansion chamber of the water muffler into two expansion chambers.

17. The exhaust apparatus according to claim 11, wherein the rear exhaust pipe is operatively connected to the expansion chamber at a point adjacent to an opening formed in a lower portion of a water restraining panel that partitions the expansion chamber of the water muffler into two expansion chambers.

18. The exhaust apparatus according to claim 17, wherein an opening of the rear exhaust pipe is normally disposed below a waterline within said water muffler and is disposed above the waterline within said water muffler at a predetermined speed.

19. The exhaust apparatus according to claim 11, wherein a partitioning panel partitions the water muffler into the expansion chamber and the resonator chamber, the connecting pipe is operatively connected to the midsection of the rear exhaust pipe and projects through said partitioning panel to extend into the resonator chamber, wherein a side of the partitioning panel facing the resonator chamber is concave-shaped.

20. The exhaust apparatus according to claim 19, wherein the partitioning panel includes an aperture in a lower portion thereof for permitting water to flow from the resonator chamber to the expansion chamber.

* * * * *

UNITED STATES PATENT AND TRADEMARK OFFICE

CERTIFICATE OF CORRECTION

PATENT NO. : 7,886,870 B2
APPLICATION NO. : 12/055036
DATED : February 15, 2011
INVENTOR(S) : Toshinori Hanai et al.

It is certified that error appears in the above-identified patent and that said Letters Patent is hereby corrected as shown below:

ON THE TITLE PAGE:

Insert the following as item (30):

-- (30) Foreign Application Priority Data

Mar. 28, 2007 (JP) ..... 2007-085444 --.

Signed and Sealed this
Seventeenth Day of May, 2011

David J. Kappos

David J. Kappos
*Director of the United States Patent and Trademark Office*